US005163267A

United States Patent [19]

Thompson

[11] Patent Number: 5,163,267

[45] Date of Patent: Nov. 17, 1992

[54] APPARATUS FOR SEPARATING BOTTLES IN A PACK

[76] Inventor: James D. Thompson, 715 Cedar Lake Rd., SW., Decatur, Ala. 35603

[21] Appl. No.: 822,193

[22] Filed: Jan. 17, 1992

[51] Int. Cl.[5] ..... B65B 21/18; B65B 21/14

[52] U.S. Cl. ..... 53/381.1; 414/417; 294/86.29

[58] Field of Search ..... 53/381.1, 492, 48.2, 53/48.3; 414/788, 403, 411, 417; 294/86.29, 87.22; 254/199

[56] References Cited

U.S. PATENT DOCUMENTS

| | | | |
|---|---|---|---|
| 2,675,263 | 4/1954 | Jennings et al. | 294/86.29 X |
| 2,932,876 | 4/1960 | Zevely | 414/417 X |
| 3,780,892 | 12/1973 | Frank | 414/417 X |
| 3,889,442 | 6/1975 | Grahn et al. | 53/492 |
| 4,390,313 | 6/1983 | Hoehn | 53/381.2 X |
| 4,457,123 | 7/1984 | Hoehn | 53/381.2 X |

*Primary Examiner*—Horace M. Culver

[57] ABSTRACT

An apparatus for separating bottles held together by a molded plastic sheet having a depending peripheral edge, wherein the ends of a plurality of fingers carried by a moveable frame extend inwardly to positions below the depending edge of and inside the periphery of the molded sheet when the frame is moved downward. A support member positioned above the fingers and moveably mounted on the frame is provided with a plurality of depending posts which are positioned in a pattern which is congruent to the pattern of the bottle necks, these posts serving to prevent upward movement of the bottles when the frame and fingers are moved upwardly to strip the molded sheet from the necks of the bottles.

7 Claims, 1 Drawing Sheet

APPARATUS FOR SEPARATING BOTTLES IN A PACK

FIELD OF THE INVENTION

This invention relates to apparatus for separating bottles in a six pack.

PRIOR ART

Soft drinks are sold in packs of six, with the six bottles being held together by a relatively stiff plastic sheet molded into a certain configuration, the necks of the bottles extending through holes in the sheet to hold the bottles in place. The plastic sheet is provided with a pair of holes into which a thumb and a finger may be inserted for carrying the six pack.

One of the major disadvantages of this is that it is difficult to remove the bottles from the sheet. One holds the plastic sheet with one hand and pulls on the bottle to be removed with the other. Sufficient force is required to remove the bottle that one risks striking a nearby objects with the bottle when it suddenly release from the sheet. Older people or those in poor health may not have the strength to pull a bottle out of the pack.

Many stores, especially convenience stores, sell soft drinks by the individual bottle. These drinks are stored in a drink cooler as individual bottles, not as part of a six pack. This means that a store employee must remove the bottles from the six pack before they can be put into the cooler. This requires six removals for each six pack. Much time and effort could be saved if this problem could be solved.

SUMMARY OF THE INVENTION

An apparatus for separating bottles held together by a molded plastic sheet having a depending peripheral edge, wherein the ends of a plurality of fingers carried by a moveable frame extend inwardly to positions below the depending edge of and inside the periphery of the molded sheet when the frame is moved downward. A support member positioned above the fingers and moveably mounted on the frame is provided with a plurality of depending posts which are positioned in a pattern which is congruent to the pattern of the bottle necks, these posts serving to prevent upward movement of the bottles when the frame and fingers are moved upwardly to strip the molded sheet from the necks of the bottles.

DETAILED DESCRIPTION OF THE INVENTION

Referring now in detail to the drawings, there is shown a frame which is made up of a pair of generally U-shaped elements 11 having their ends secured to a loop 12, with a handle 15 being secured to the elements

11. All of these parts may be made from steel, with the various parts being together.

Figure 1:
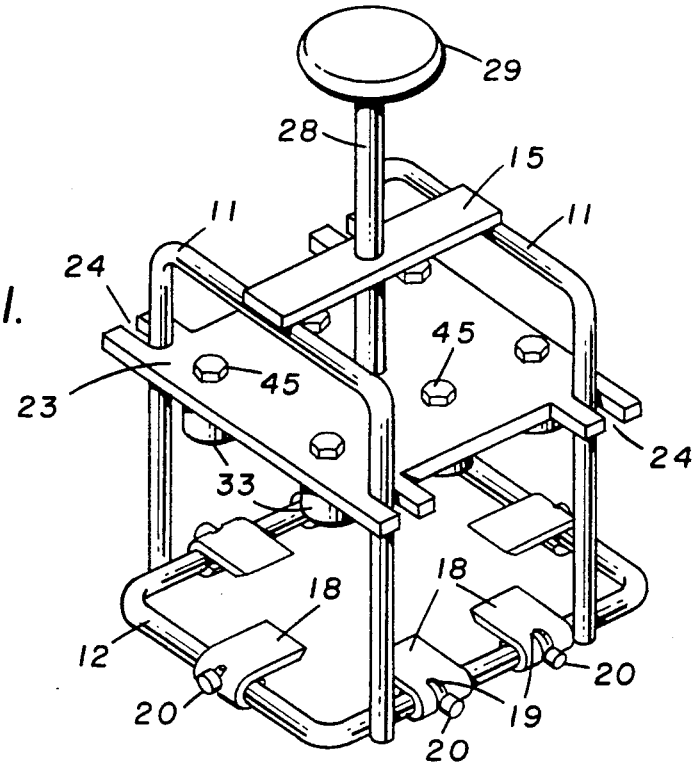
FIG. 1 is a perspective view of the apparatus of this invention showing the relationship of the various parts of the apparatus.
Figure 2:
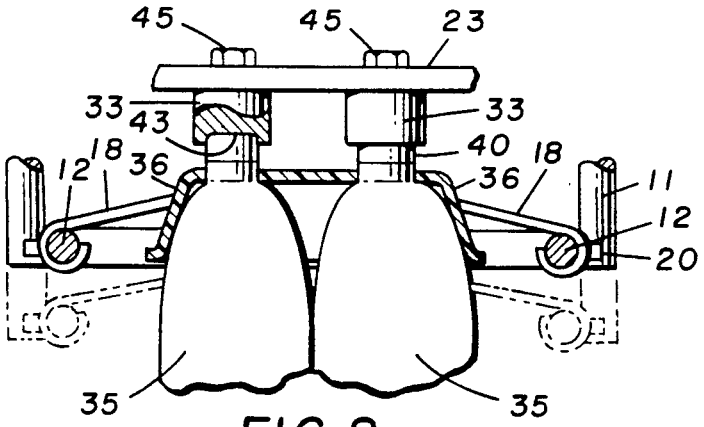
FIG. 2 is a fragmentary cross sectional view showing different positions assumed by the lifting fingers as the frame is moved downward.
Figure 3:
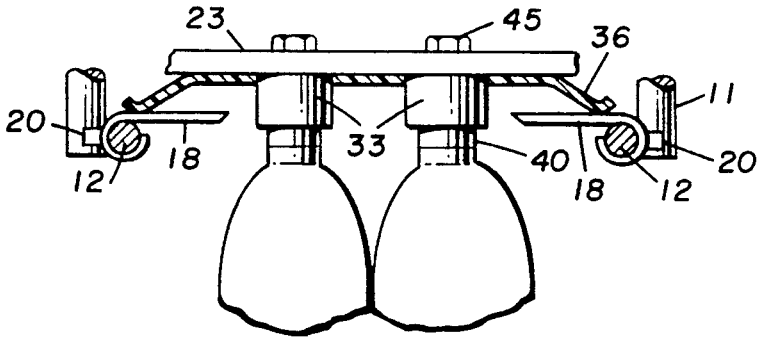
FIG. 3 is a view of the structure shown in FIG. 2 after the molded plastic sheet has been stripped from the six pack to free the bottles.

Positioned around the loop 12 are a plurality of fingers 18, each of which has an end which wraps in an arcuate curve, coaxial with the loop, at least partially around the loop 12 so that each of the fingers can pivot on the loop 12 from the generally horizontal position shown in FIGS. 1 and 3 to the raised positions shown in FIG. 2. Each of the fingers 18 is provided with a slot 19, perpendicular to the axis of the loop, through which a bolt 20 is threaded into the loop 12. The length of the slots 19 limits the pivotal movement of the fingers 18 to about 45°.

A support plate 23 is provided with a plurality of spaced slots in which are positioned the vertical legs of the U-shaped elements. A push rod 28 secured to the support plate 23 extends through a hole in the handle 15 and terminates in a circular second handle 29. It can readily be seen that the support plate 23 is free to move vertically relative to the frame but is not free to pivot about the axis of the push rod 28.

The support plate as has attached thereto a plurality of posts 33 (best seen in FIGS. 2 and 3) arranged in a pattern congruent to the pattern in which bottles 35 are held by a molded plastic sheet 36, with the posts 33 being so positioned that each post will rest on the top of one of the bottle caps 40 when the apparatus is lowered into position on a six pack of drinks. A portion of one of the posts 33 is cut away in FIG. 2 to show a recess 43 in the bottom of the post. These recesses in the lower ends of the posts positively align the posts with the bottle caps 40. The posts 33 are held on the support plate 23 by bolts 45.

In operation, the device is lowered until the lower ends of the posts 33 rest on the caps 40 of the bottles. Because of its weight, the frame will continue to move downward, carries the loop 12 with it. As the loop 12 moves downward, it carries the finger past the depending lower edge of the sheet 36, the fingers 18 being free to pivot upwardly as shown in FIG. 2 to clear the sheet 36. When the inner ends of the fingers 18 pass downward and clear the sheet 36, they drop to generally horizontal positions as shown in dashed lines in FIG. 2. At this point, the free inner ends of the fingers 18 are below and inside the periphery of the depending edge of the sheet 36. By "inside the periphery" it is meant that a vertical plane tangent to the depending edge of the sheet 36 will intersect the fingers 18.

After the loop 12 has carried the fingers 18 to the position shown in dashed lines in FIG. 2, the user places his palm on the circular handle 29, grasps the handle 15 with his fingers and squeezes. This raises the loop 12 and the fingers 18 to strip the sheet 36 from the bottles 35 and move it to the position shown in Figure. The bottles are now free from the sheet 36 and it is done in one quick squeeze.

What is claimed is:

1. A device for separating a plurality of bottles held together by a molded sheet of synthetic material having a depending edge extending around the periphery thereof, the bottles being spaced in a predetermined pattern and having necks extending through apertures in the sheet for holding said bottles in said pattern, comprising a. a frame, b. a plurality of fingers mounted on the frame, said fingers having ends projecting inwardly, said ends being so positioned that when the frame is lowered to move the fingers downward past said molded sheet the ends of the fingers are below and inside the periphery of said depending edge, c. a support member moveably mounted on the frame for movement in a vertical direction relative to said frame, and d. a plurality of downwardly projecting posts attached to the support member in a pattern congruent to the pattern in which said bottles are held such that when the frame is moved upwardly relative to the support member the posts engage and hold the bottle necks against movement as the ends of the fingers engage and move the depending edge of the sheet upward to remove the sheet from the bottles.

2. The apparatus of claim 1 wherein lower ends of the posts are provided with recesses which receive upper ends of the necks of the bottles to prevent lateral movement of said necks relative to said posts.

3. The apparatus of claim 2 wherein the fingers are mounted on the frame for pivotal movement between an upper position and a lower position.

4. The apparatus of claim 3 wherein the fingers are in a generally horizontal position when in said lower position.

5. The apparatus of claim 3 wherein the frame is provided with a first handle having therein an opening and the support member is provided with a second handle connected to the support member by a push rod extending through the opening in said first handle.

6. A device for separating a plurality of bottles held together by a molded sheet of synthetic material having a depending edge extending around the periphery thereof, said bottles being positioned in a predetermined pattern and having necks extending through apertures in the sheet for holding said bottles in said pattern, comprising a. a frame made up of a horizontal loop, a first handle and a pair of U-shaped elements having downwardly extending legs secured at lower ends thereof to the loop at opposite sides thereof, said handle being secured to upper ends of said U-shaped elements and having therein a central opening, b. a plurality of fingers each having a free end and an end pivotally attached to the loop, said fingers extending inwardly from the loop, c. means attached to the loop for limiting movement of the fingers from a generally horizontal position to a position about 45° above horizontal, said fingers and said loop having sizes such that when the loop is moved downward to a position where the ends of the fingers are below the depending edge of the sheet the free ends of the fingers extend to positions inside the periphery of said depending edge, d. a support member having a plurality of slots positioned to receive the legs of the U-shaped elements for guiding said support member as it is moved vertically relative to the frame, e. a plurality of downwardly extending posts secured to the support member, said posts being positioned in a pattern congruent to the pattern of the necks of the bottles, said posts having in lower ends thereof recesses for receiving the necks of the bottle to prevent lateral movement of the bottles, f. a push rod secured to the support member and extending vertically through the central opening in the handle, and g. a second handle secured to the upper end of the push rod.

7. The apparatus of claim 6 wherein the ends of the fingers pivotally attached to the loop are in the form of an arcuate curve coaxial with a loop axis, with each finger being provided with a slot perpendicular to the axis of said arcuate curve and the loop being provided with set screws extending through each of said slots and being threaded into said loop for limiting movement of said fingers.

* * * * *